US007112924B2

(12) United States Patent
Hanna

(10) Patent No.: US 7,112,924 B2
(45) Date of Patent: Sep. 26, 2006

(54) ELECTRONIC ENERGY SWITCH FOR PARTICLE ACCELERATOR

(75) Inventor: Samy M. Hanna, Danville, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 10/819,389

(22) Filed: Apr. 6, 2004

(65) Prior Publication Data

US 2005/0057198 A1 Mar. 17, 2005

Related U.S. Application Data

(60) Provisional application No. 60/497,160, filed on Aug. 22, 2003.

(51) Int. Cl.
*H01J 25/10* (2006.01)
*H01J 25/00* (2006.01)

(52) U.S. Cl. ..... 315/5.41; 315/5.42; 315/500

(58) Field of Classification Search ..... 315/5.41, 315/5.42, 5.46, 5.53, 500, 506
See application file for complete search history.

(56) References Cited

U.S. PATENT DOCUMENTS 4,382,208 A * 5/1983 Meddaugh et al. ..... 315/5.41
4,400,650 A * 8/1983 Giebeler, Jr. ..... 315/5.41
4,629,938 A * 12/1986 Whitham ..... 315/5.41
4,746,839 A * 5/1988 Kazusa et al. ..... 315/5.41
5,280,252 A * 1/1994 Inoue et al. ..... 315/500
5,451,847 A * 9/1995 Nakanishi ..... 315/505
5,532,210 A * 7/1996 Shen ..... 505/200
5,744,919 A * 4/1998 Mishin et al. ..... 315/505
5,906,768 A * 5/1999 Kakinuma et al. ..... 252/62.62
5,917,293 A * 6/1999 Saito et al. ..... 315/505
6,313,710 B1 * 11/2001 Chen et al. ..... 331/83
6,366,021 B1 * 4/2002 Meddaugh et al. ..... 315/5.41
6,407,505 B1 * 6/2002 Bertsche ..... 315/5.41
6,426,681 B1 * 7/2002 Amini ..... 333/24 R
6,856,105 B1 * 2/2005 Yao et al. ..... 315/505
2001/0013785 A1 * 8/2001 Yao ..... 324/633
2002/0190670 A1 * 12/2002 Pappo et al. ..... 315/500
2005/0110440 A1 * 5/2005 Whitham et al. ..... 315/500

* cited by examiner

*Primary Examiner*—Wilson Lee
*Assistant Examiner*—Angela M Lie

(57) ABSTRACT

Some embodiments include an accelerator waveguide to receive RF power, the accelerator waveguide comprising a side cavity, an element fixedly disposed within the side cavity, and a device coupled to the element, wherein the device and the element are operable to control a resonant frequency of the side cavity.

38 Claims, 9 Drawing Sheets

ELECTRONIC ENERGY SWITCH FOR PARTICLE ACCELERATOR

CROSS REFERENCE TO RELATED APPLICATIONS

This application claims priority to Provisional Application Ser. No. 60/497,160, filed Aug. 22, 2003 and entitled "Electronic Energy Switch for Medical Accelerators".

BACKGROUND

1. Field

The embodiments described herein relate generally to particle accelerators. More particularly, the described embodiments relate to particle accelerators capable of providing a plurality of radiation dose rates.

2. Description

A particle accelerator produces charged particles having particular energies. In one common application, a particle accelerator produces a radiation beam used for medical radiation therapy. The beam may be directed toward a target area of a patient in order to destroy cells within the target area by causing ionizations within the cells.

A conventional particle accelerator includes a particle source, an accelerator waveguide and a microwave power source. The particle source may comprise an electron gun that generates and transmits electrons to the waveguide. The waveguide receives electromagnetic waves from the microwave power source, which may comprise as a magnetron or a klystron. The electrons are accelerated through the waveguide by oscillations of the electromagnetic waves within cavities of the waveguide.

The accelerating portion of the waveguide includes cavities that are designed to ensure synchrony between electrons received from the particle source and the oscillating electromagnetic wave received from the microwave power source. More particularly, the cavities are carefully designed and fabricated so that electric currents flowing on their surfaces generate electric fields that are suitable to accelerate the electron bunches. The oscillation of these electric fields within each cavity is delayed with respect to an upstream cavity so that a particle is further accelerated as it arrives at each cavity.

A conventional particle accelerator may output particles at a particular dose rate that depends upon, among other factors, the electron current received from the particle source and the power of the electromagnetic wave received from the microwave power source. A different dose rate may be achieved, in some instances, by varying the electron current and the power of the electromagnetic wave. However, varying these factors may cause an undesirable change in the value of the energy of the output particles.

SUMMARY

In order to address the foregoing, some embodiments provide a system, method, apparatus, and means to operate an accelerator waveguide to output first particles at a first dose rate, to operate an element fixedly disposed within a side cavity of the accelerator waveguide and a device coupled to the element to change a resonant frequency of the side cavity, and to operate the accelerator waveguide to output second particles at a second dose rate. In some aspects of the foregoing, the first particles are output at a first energy and the second particles are output at substantially the first energy.

Some embodiments provide an accelerator waveguide to receive RF power, the accelerator waveguide comprising a primary cavity, a side cavity coupled to the primary cavity, and one or more downstream primary cavities that are disposed downstream from the primary cavity. Also provided may be an element fixedly disposed within the side cavity, and a device coupled to the element. The device and the element may be operable to selectively change a percentage of received RF power delivered to the downstream primary cavities.

According to some aspects, provided are an accelerator waveguide to receive RF power, the accelerator waveguide comprising a side cavity, an element fixedly disposed within the side cavity, and a device coupled to the element, wherein the device and the element are operable to control a resonant frequency of the side cavity.

The claimed invention is not limited to the disclosed embodiments, however, as those in the art can readily adapt the descriptions herein to create other embodiments and applications.

BRIEF DESCRIPTION OF THE DRAWINGS

Embodiments of the claimed invention will become readily apparent from consideration of the following specification as illustrated in the accompanying drawings, in which like reference numerals designate like parts, and wherein:

DETAILED DESCRIPTION

The following description is provided to enable a person in the art to make and use embodiments of the claimed invention and sets forth the best mode contemplated by the inventor for carrying out the claimed invention. Various modifications, however, will remain readily apparent to those in the art.

Figure 1:
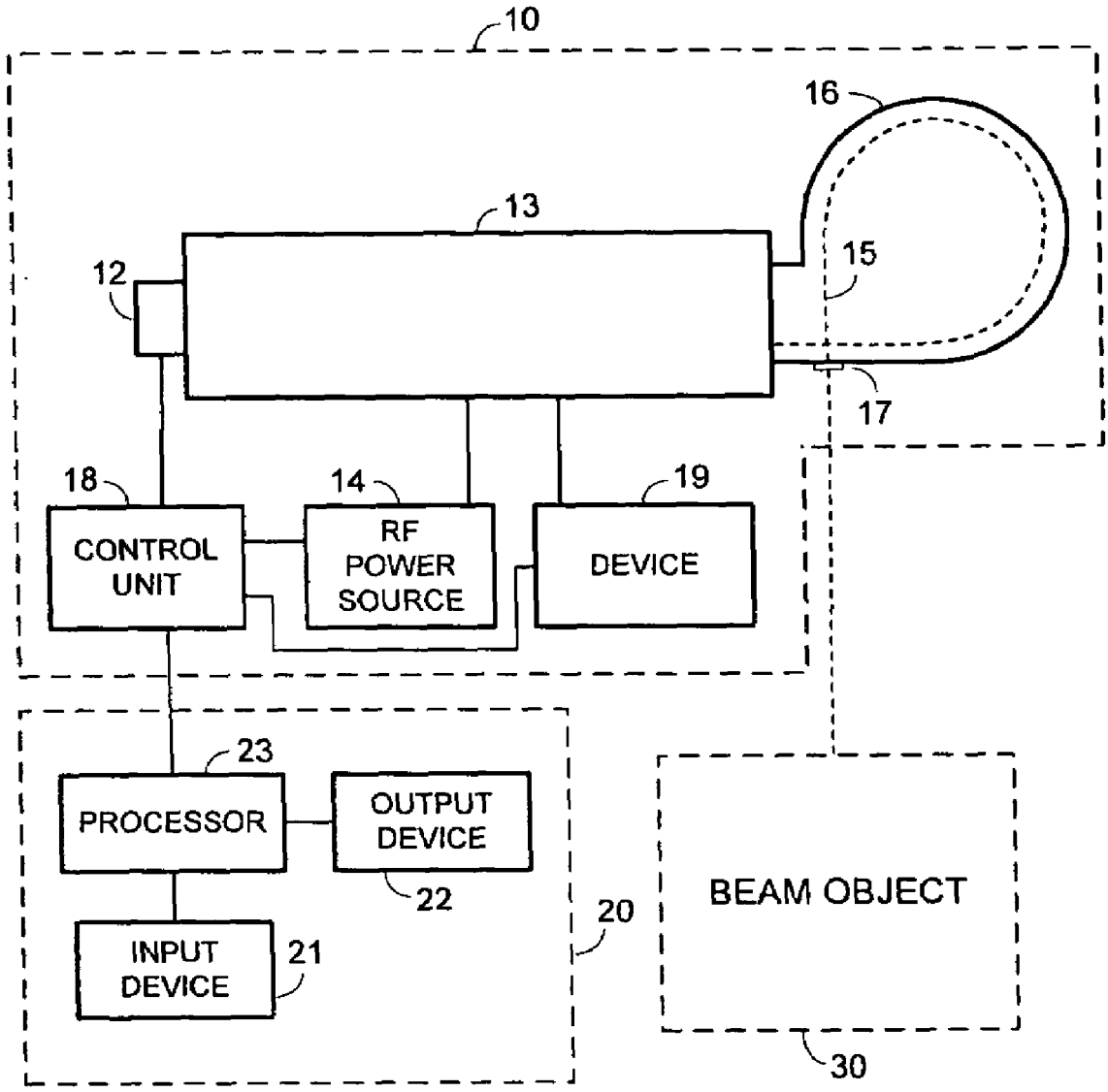
FIG. 1 is block diagram depicting a particle accelerator system according to some embodiments.

FIG. 1 illustrates a system according to some embodiments. The system includes particle accelerator 10, operator console 20 and beam object 30.

Particle accelerator 10 may be used to output particles toward beam object 30 in response to commands received from operator console 20. In some embodiments, the output particles have a first dose rate when particle accelerator 10 is operated in a first mode and have a second dose rate when particle accelerator 10 is operated in a second mode. An energy of the output particles is substantially identical in each mode according to some embodiments.

Particle accelerator 10 includes particle source 12 for injecting particles such as electrons into accelerator waveguide 13. Particle source 12 may comprise a heater, a thermionic cathode, a control grid, a focus electrode and an anode. Accelerator waveguide 13 may include a "buncher" section of cavities that operate to bunch the electrons and a second set of cavities to accelerate the bunched electrons. Some embodiments of particle accelerator 10 may include a prebuncher for receiving particles from particle source 12 and for bunching the electrons before the electrons are received by accelerator waveguide 13. RF power source 14 may comprise a magnetron or Klystron coupled to the cavities of accelerator waveguide 13 in order to provide an electromagnetic wave thereto.

In one example of operation according to some embodiments, accelerator waveguide 13 receives an electromagnetic wave from RF power source 14 and electrons from particle source 12. The buncher section prepares the electrons for subsequent acceleration by a second portion of waveguide 13. In particular, the buncher may include tapered cavity lengths and apertures so that the phase velocity and field strength of the received electromagnetic wave begin low at the input of the buncher and increase to values that are characteristic to the accelerating portion. Typically, the characteristic phase velocity is equal to the velocity of light. As a result, the electrons gain energy and are bunched toward a common phase as they travel through the buncher.

Accelerator waveguide 13 outputs beam 15 to bending magnet 16. Beam 15 includes a stream of electron bunches having a particular energy and bending magnet 16 comprises an evacuated envelope to bend beam 15 270 degrees before beam 15 exits bending magnet 16 through window 17. Beam 15 is received by beam object 30, which may comprise a patient, a target for generating bremsstrahlung photon radiation, or another object.

Control unit 18 controls an injection voltage and beam current of particle source 12, and a frequency and power of the electromagnetic wave based on operator instructions and/or feedback from elements of particle accelerator 10 and/or another system. Control unit 18 also controls device 19.

As will be described in detail below, device 19 may be coupled to an element (not shown) disposed within a side cavity (not shown) of accelerator waveguide 13. Device 19 and the element may be operable to selectively change a percentage of received RF power that is delivered to cavities that are located downstream from the side cavity. In some embodiments, device 19 and the element are operable to control a resonant frequency of the side cavity. The element may be fixedly disposed within the side cavity so as to reduce a possibility of disturbing a vacuum maintained within waveguide 13 during the operations mentioned above.

Operator console 20 includes input device 21 for receiving instructions from an operator and processor 22 for responding to the instructions. Operator console 20 communicates with the operator via output device 22, which may be a monitor for presenting operational parameters and/or a control interface of particle accelerator 10. Output device 22 may also present images of beam object 30 to confirm proper delivery of beam 15 thereto.

In one example of operation according to some embodiments, an operator issues a command to output a 6 MeV beam having a first dose rate using input device 21. Processor 22 transmits the command to control unit 18, which in turn sets a grid voltage of particle source 12 to generate a beam current corresponding to the desired output energy. Control unit 18 also sets a power of the wave emitted by RF power source 14 based on the desired energy. As a result, particle accelerator 10 outputs particles at the desired energy and dose rate.

After the particles have been output, the operator may issue a command to output a 6 MeV beam having a second dose rate that is greater than the first dose rate. Processor 22 again transmits the command to control unit 18, which increases the beam current and/or the RF wave power to correspond to the newly-desired dose rate. Moreover, control unit 18 issues a command so that device 19 and an element within a side cavity of operate to reduce a percentage of received RF power that is delivered to cavities that are located downstream from the side cavity. Such operation may in turn increase a percentage of the received RF power that is delivered upstream towards the buncher cavities. Particles are thereafter output from waveguide 13 at substantially the same energy as before (i.e., 6 MeV) but at the second, higher, dose rate.

Figure 2:
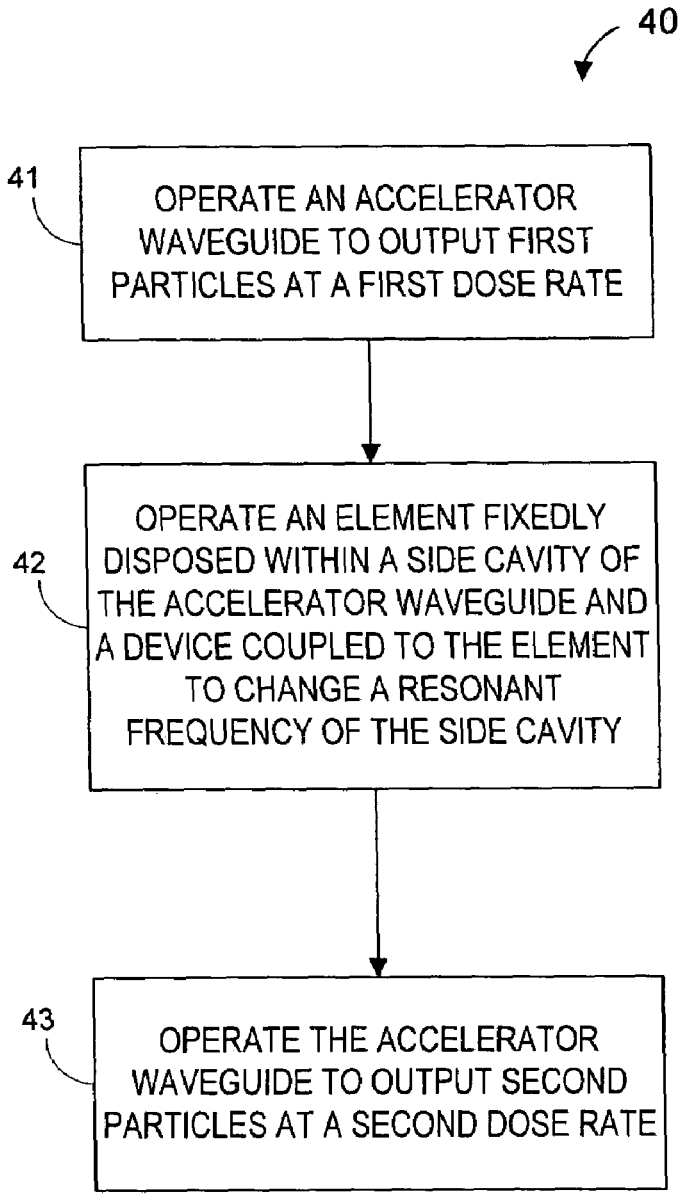
FIG. 2 is a flow diagram of process steps pursuant to some embodiments.

FIG. 2 is a flow diagram of process steps 40 according to some embodiments. Process steps 40 may be executed by one or more elements of particle accelerator 10, operator console 20, and other devices. Accordingly, process steps 40 may be embodied in hardware and/or software. Process steps 40 will be described below with respect to the above-described elements, however it will be understood that process steps 40 may be implemented and executed differently than as described below.

Prior to step 41, particle accelerator 10 may receive a command from console 20 to output first particles at a first dose rate. In response, accelerator waveguide 13 is operated to output first particles at the first dose rate in step 41. Output of the first particles at a first dose rate may be considered a first mode of operation.

Figure 3:
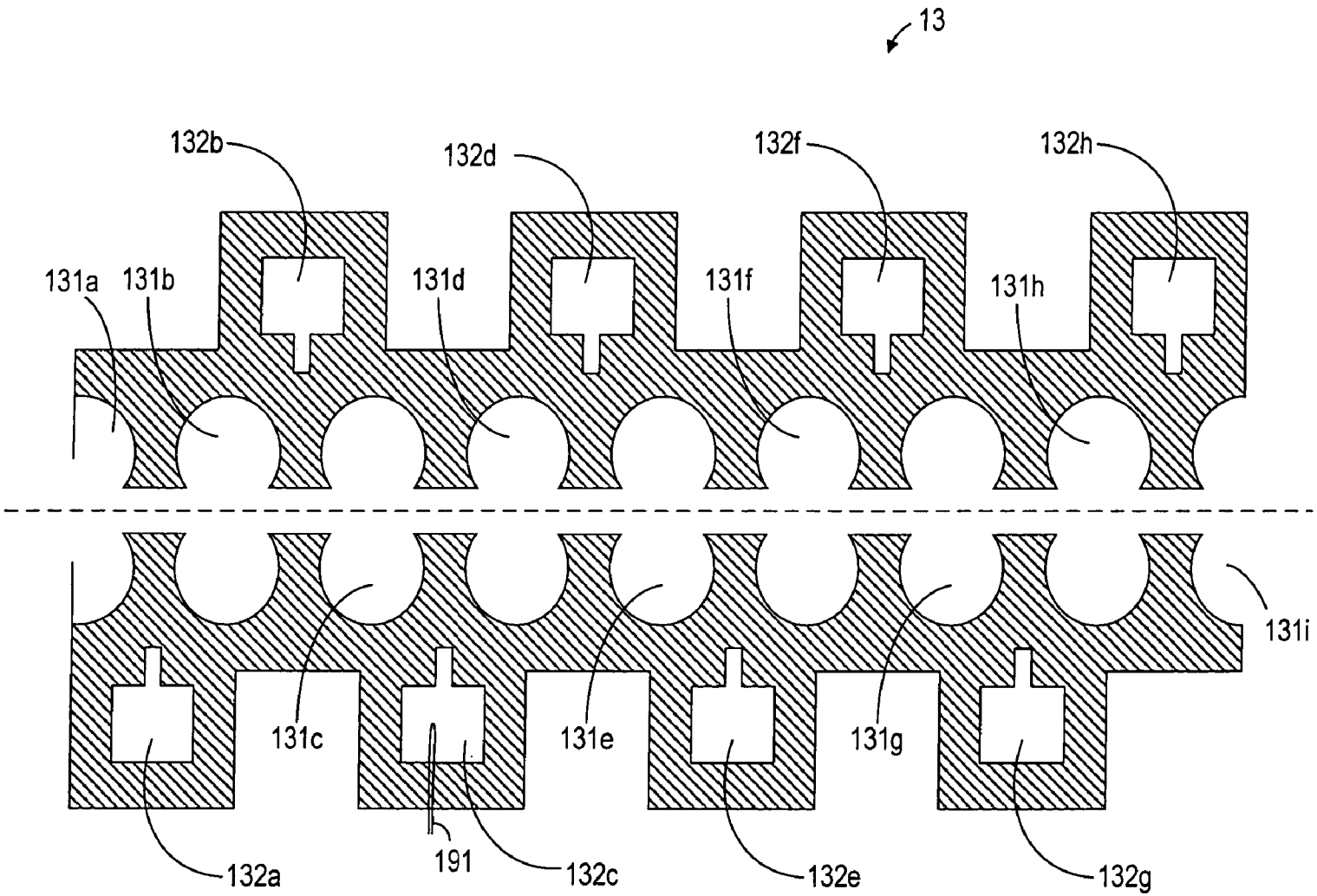
FIG. 3 is a cross-section of an accelerator waveguide according to some embodiments.

FIG. 3 is a cross-sectional view of accelerator waveguide 13 for describing step 41 according to some embodiments. Accelerator waveguide 13 has a plurality of primary cavities 131*a–i* disposed along a central axis. Primary cavities 131*a–i* are arranged and formed to accelerate particles along waveguide 13.

A plurality of side cavities 132*a–h* are also provided. Each side cavity is disposed between pairs of primary cavities to provide side coupling between primary cavities. For example, side cavity 132*b* provides coupling between primary cavities 131*b* and 131*c*. The design and arrangement of these cavities is known to those in the art.

Conductor loop 191 is an element that is fixedly disposed within side cavity 132*c* of waveguide 13. Conductor loop 191 may comprise any electrical conductor, including but not limited to an inner conductor of a coaxial cable that is formed into a loop. Conductor loop 191 may be manufactured integrally with waveguide 13 or may be inserted into waveguide 13 through an opening that is thereafter sealed such that a vacuum may be maintained within waveguide 13.

A first few primary cavities of accelerator waveguide 13 may operate as a buncher to increase a phase velocity of the particle bunches to that of the received RF wave. Once the velocities are synchronized, the particle bunches will pass through each successive cavity during a time interval when the electric field intensity in the cavity is at a maximum. Each of cavities 131*a–i* as well as 132*a–h* may be designed and constructed to exhibit a particular resonant frequency in order to ensure that the particle bunches pass through each cavity during this time interval.

Figure 4:
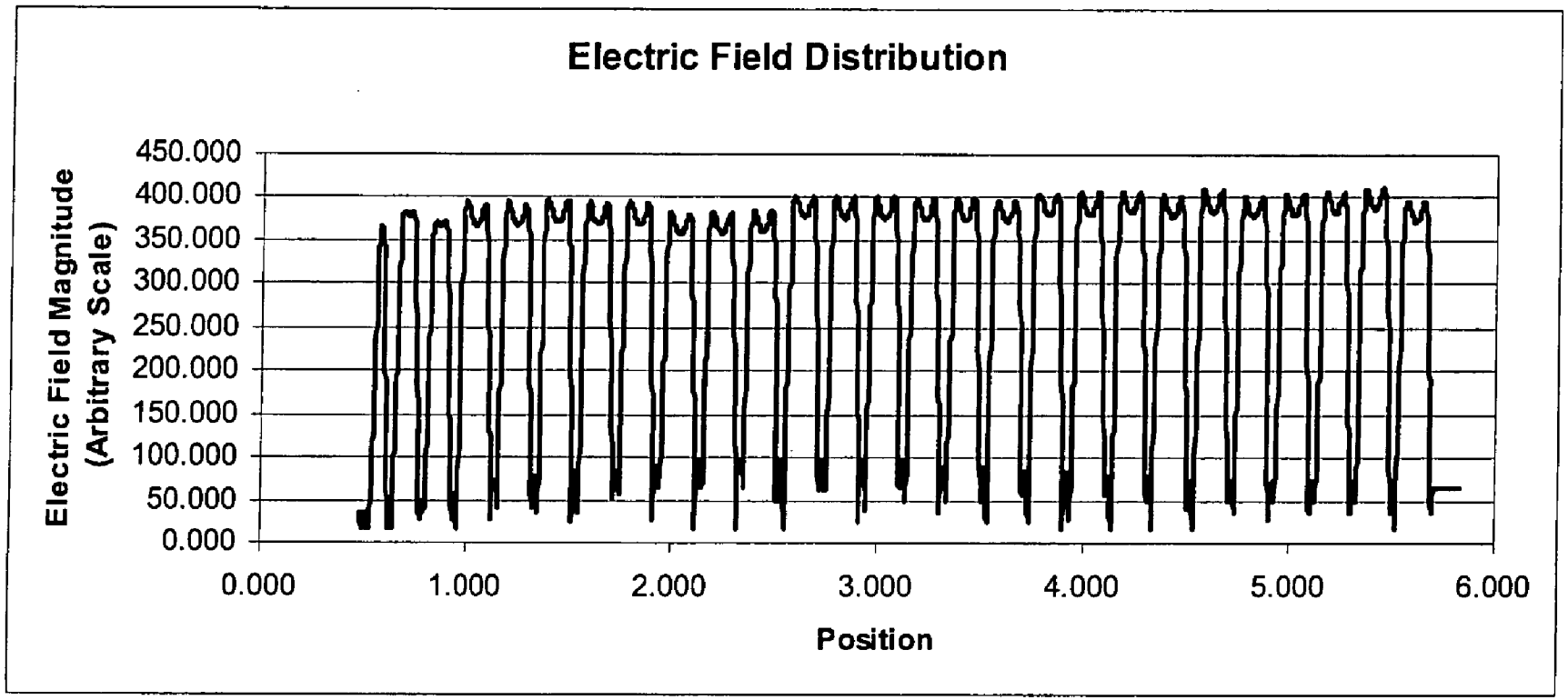
FIG. 4 is a graph illustrating an electric field distribution in an accelerator waveguide according to some embodiments.

Each cavity, including side cavity 132*c*, may be tuned to its particular resonant frequency at step 41 and particle bunches may therefore pass therethrough when the electric field intensity in each successive cavity is at a maximum. FIG. 4 illustrates a magnitude of an electric field within waveguide 13 when each cavity is tuned to its particular resonant frequency and waveguide 13 is operated in step 41 according to some embodiments. In the present example, it will be assumed that the particles are output from waveguide 13 in step 41 at the first dose rate and at a first energy.

Figure 5:
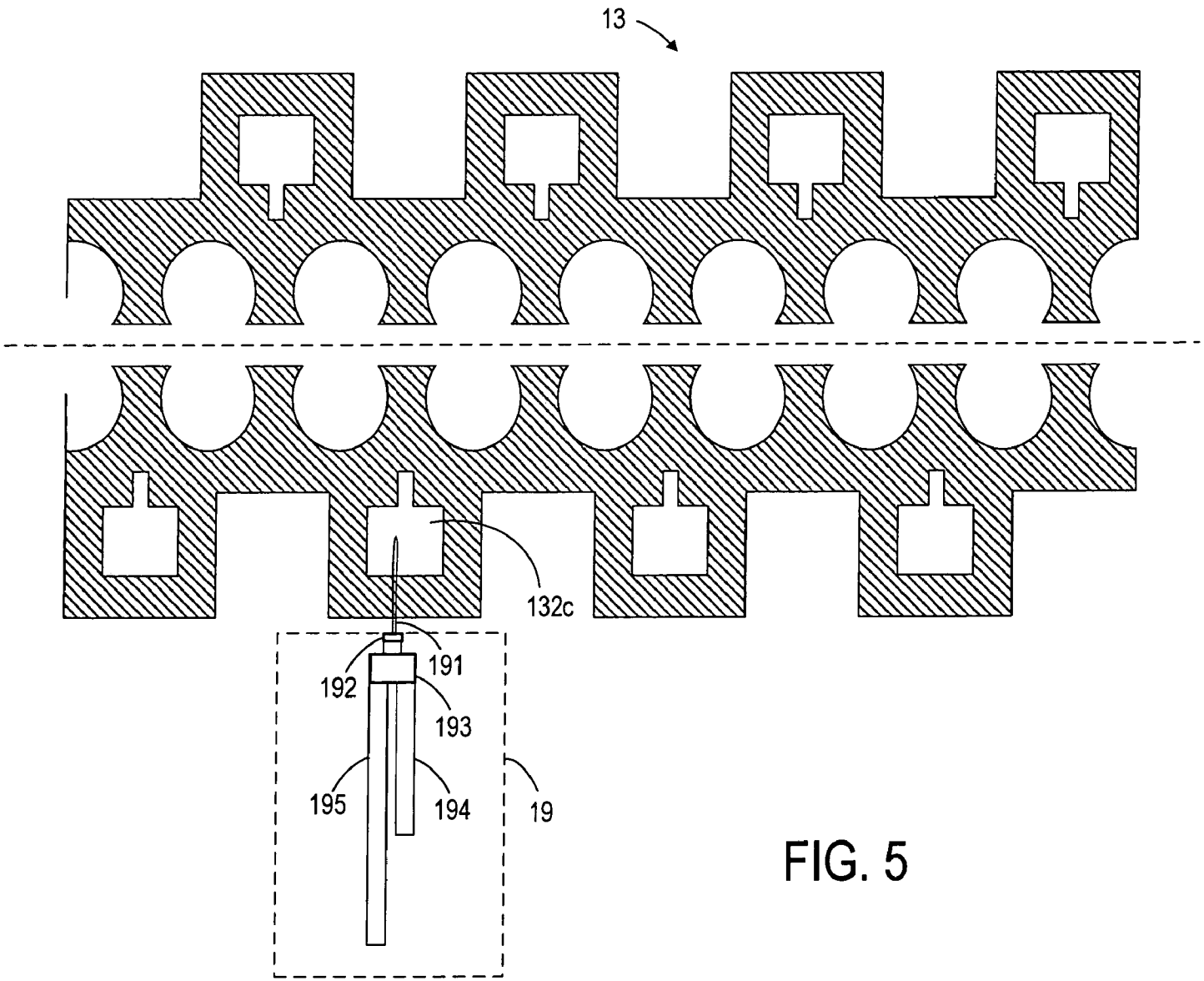
FIG. 5 is a cross-section of an accelerator waveguide according to some embodiments.

Next, in step 42, conductor loop 191 and device 19 are operated to change a resonant frequency of side cavity 132*c*. In some embodiments, a command to output second particles at a second dose rate is received by control unit 18 from console 20 prior to step 42. FIG. 5 illustrates side cavity 132*c* and device 19 according to some embodiments. Device 19 of FIG. 5 comprises an electrical circuit. A characteristic of the electrical circuit may be controlled so as to change an amount of reactance coupled to side cavity 132*c*.

More specifically, conductor loop 191 emerges from and returns to be coupled to conductive coaxial cable sleeve 192 of device 19. Conductor loop is coupled to switch 193, which is in turn coupled to transmission lines 194 and 195. Transmission lines 194 and 195 may comprise coaxial cable or any other suitable conductor, and each may be terminated by a short or an open. Control unit 18 may control switch 193 to selectively couple conductor loop 191 to transmission line 194 or transmission line 195. Switch 193 may comprise any suitable switch, including but not limited to a microwave switch, an electromechanical switch, a ferrite switch and a PIN diode switch.

During step 41, switch 193 may couple conductor loop 191 to transmission line 194. An amount of reactance thereby coupled to side cavity 132*c* may result in a change in the resonant frequency of side cavity 132*c* that allows the electric field magnitude shown in FIG. 4. At step 42, switch 193 may be controlled to couple conductor loop 191 to transmission line 195. Coupling transmission line 195 to conductor loop 191 may change an amount of reactance coupled to side cavity 132*c*. The changed reactance may change a resonant frequency of side cavity 132*c*.

According to some embodiments, operation of device 19 and conductor loop 191 in step 42 as described above decreases a percentage of the RF power received by waveguide 13 that is delivered to primary cavities disposed downstream from side cavity 132*c*. In the present example, these downstream primary cavities include cavities 131*d–i*.

Accelerator waveguide 13 is operated at step 43 to output second particles having a second dose rate. The present example will assume that the second dose rate is greater than the first dose rate. Such operation may comprise increasing the current of the beam emitted by particle source 12 and/or the power of the RF wave emitted by RF power source 14. Operation of accelerator waveguide 13 to output particles at the second dose rate may be considered a second mode of operation.

Figure 6:
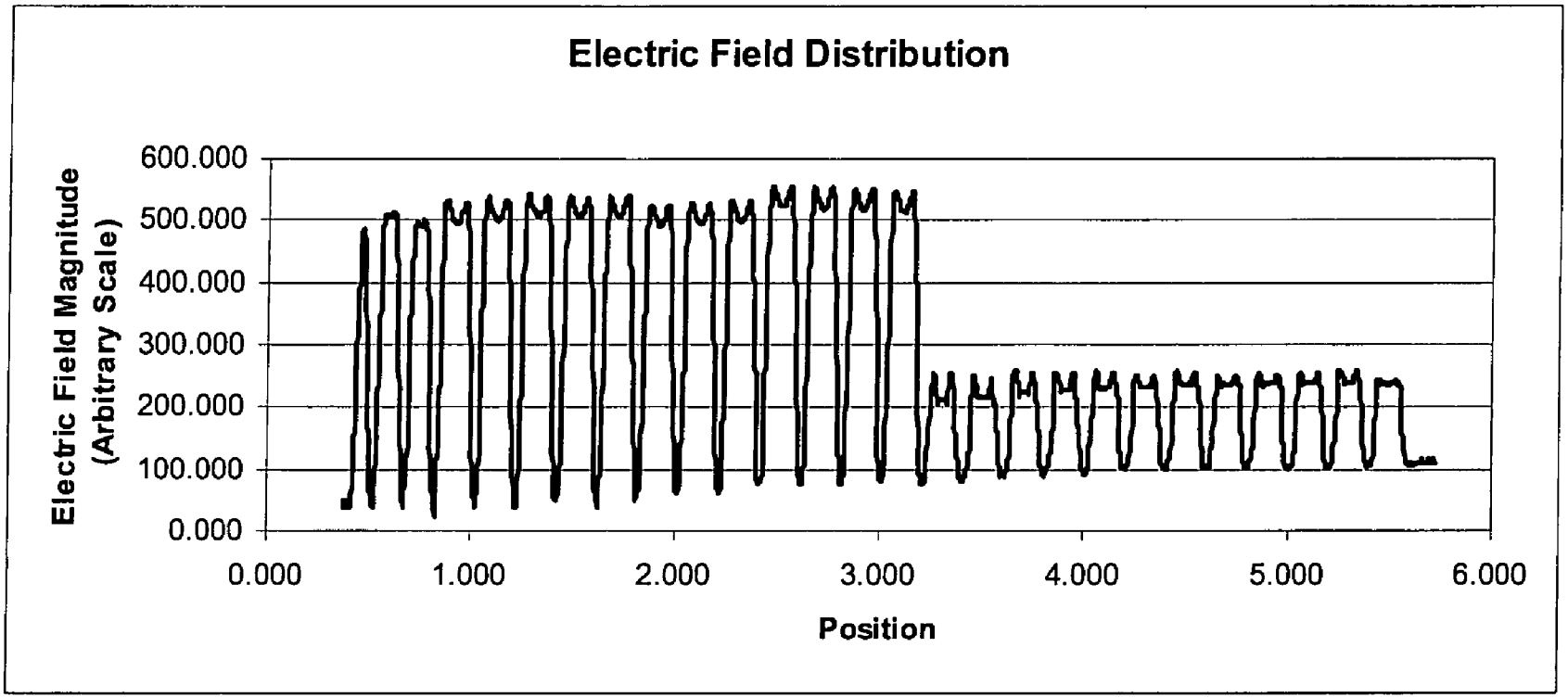
FIG. 6 is a graph illustrating an electric field distribution in an accelerator waveguide according to some embodiments.

FIG. 6 illustrates a magnitude of an electric field within waveguide 13 when a resonant frequency of side cavity 132*c* is changed and waveguide 13 is operated at step 43 according to some embodiments. The position along the Y-axis at which the magnitude of the electric field drops significantly corresponds to the position of side cavity 132*c*. The drop in magnitude may reflect a decrease in the percentage of the RF power received by waveguide 13 that is delivered to the primary cavities disposed downstream from side cavity 132*c*. As described above, this decrease may be due to the operation of device 19 and conductor loop 191 in step 42.

The drop in electric field magnitude may cause the particles that are accelerated at step 43 to experience a smaller energy gain within the downstream cavities than the particles that are accelerated at step 41. However, due to the increase in RF power and/or beam current, upstream cavities 131*a–c* may provide a greater energy gain and at least as efficient bunching as they provided in step 41. Accordingly, in some embodiments, an energy of the particles output in step 43 may be substantially equal to the energy of the particles output in step 41, although the particles output in step 43 exhibit a greater dose rate.

Figure 7:
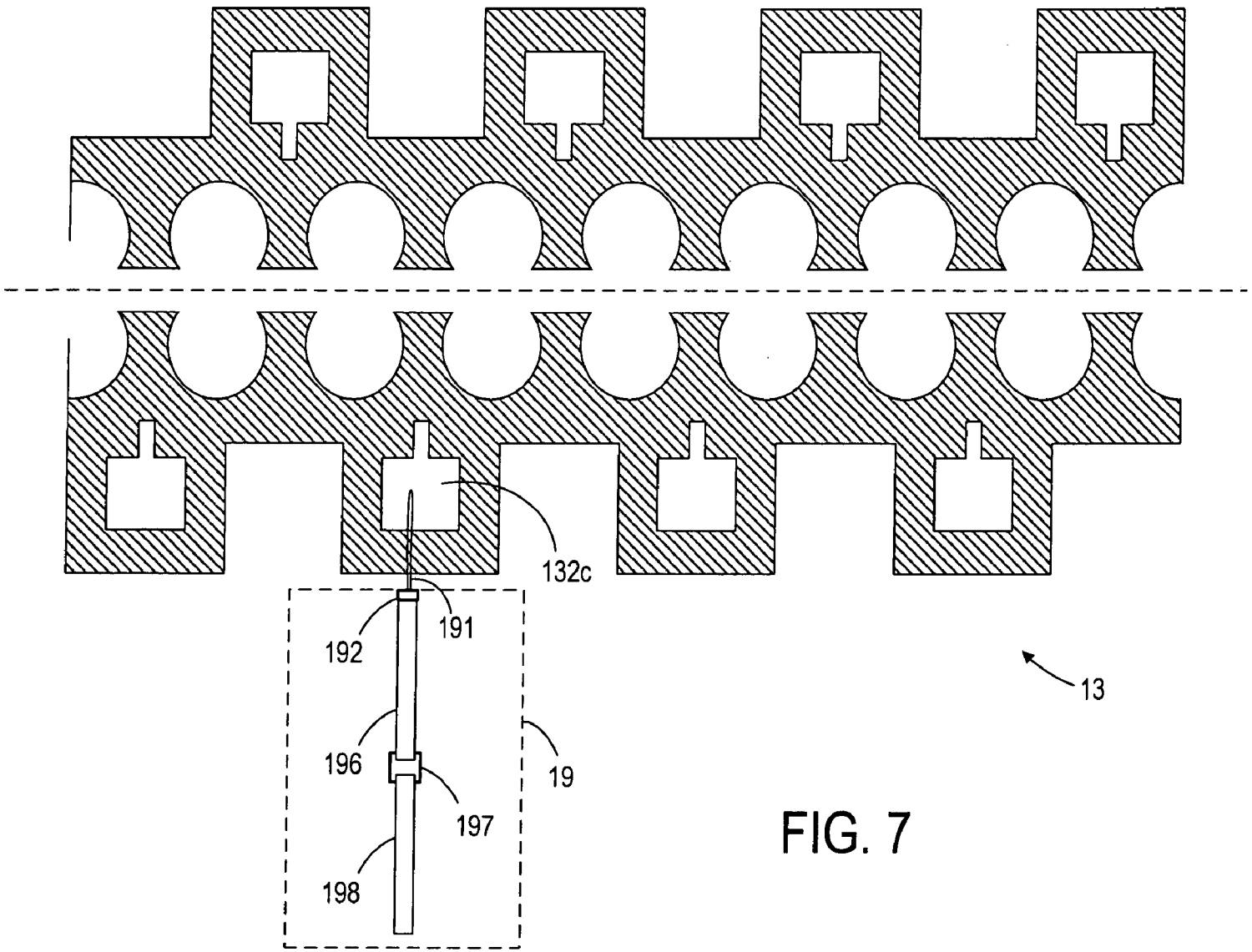
FIG. 7 is a cross-section of an accelerator waveguide according to some embodiments.

FIG. 7 is a cross-sectional view of waveguide 13 with device 19 according to some embodiments. Conductor loop 191 again emerges from and returns to be coupled to conductive coaxial cable sleeve 192. Sleeve 192 is coupled to transmission line 196, which is in turn coupled to switch 197. Transmission line 198 is also coupled to switch 197 and may be terminated by a short or an open. Control unit 18 may control switch 197 in step 42 to selectively couple or uncouple conductor loop 191 to or from transmission line 198. Such coupling/uncoupling may change a resonant frequency of side cavity 132*c*. Such coupling/uncoupling may also or alternatively change a percentage of RF power that is delivered to primary cavities disposed downstream of side cavity 132*c*.

Figure 8:
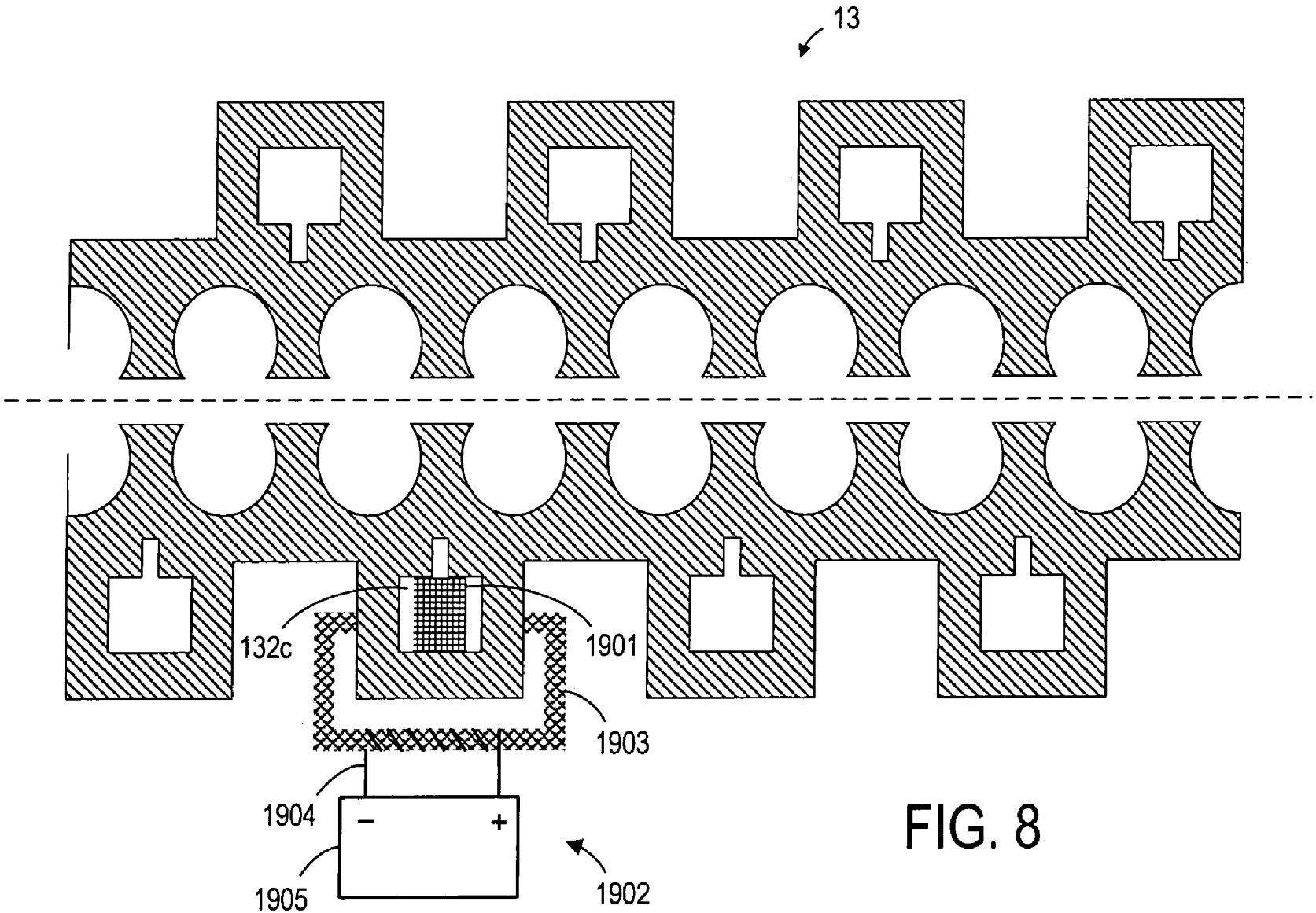
FIG. 8 is a cross-section of an accelerator waveguide according to some embodiments.

FIG. 8 is a cross-sectional view of waveguide 13 according to some embodiments. FIG. 8 shows element 1901 disposed within side cavity 132*c*. Element 1901 comprises a material that exhibits a reactance that depends on a field applied thereto. Examples of such a material include a ferrite and a ferroelectric material, but embodiments are not limited thereto.

Device 1902 of the FIG. 8 embodiment generally comprises a field device for applying a field to element 1901. Device 1902 may thereby change a reactance of element 1901 and therefore change a reactance coupled to side cavity 132*c*. As described above, the change in coupled reactance may change a resonant frequency of side cavity 132*c*. Device 1902 may also or alternatively change a percentage of RF power that is delivered to primary cavities disposed downstream of side cavity 132*c* by changing a field applied to element 1902.

Device 1902 includes core 1903, windings 1904 and power source 1905. Device 1902 of FIG. 8 therefore comprises an electromagnet for generating an electromagnet field. Any suitable core material, winding material, and power source 1905 may be used in some embodiments of device 1902. Other currently-or hereafter-known devices for changing an applied field, including a high-voltage power source, may be used according to some embodiments.

Figure 9:
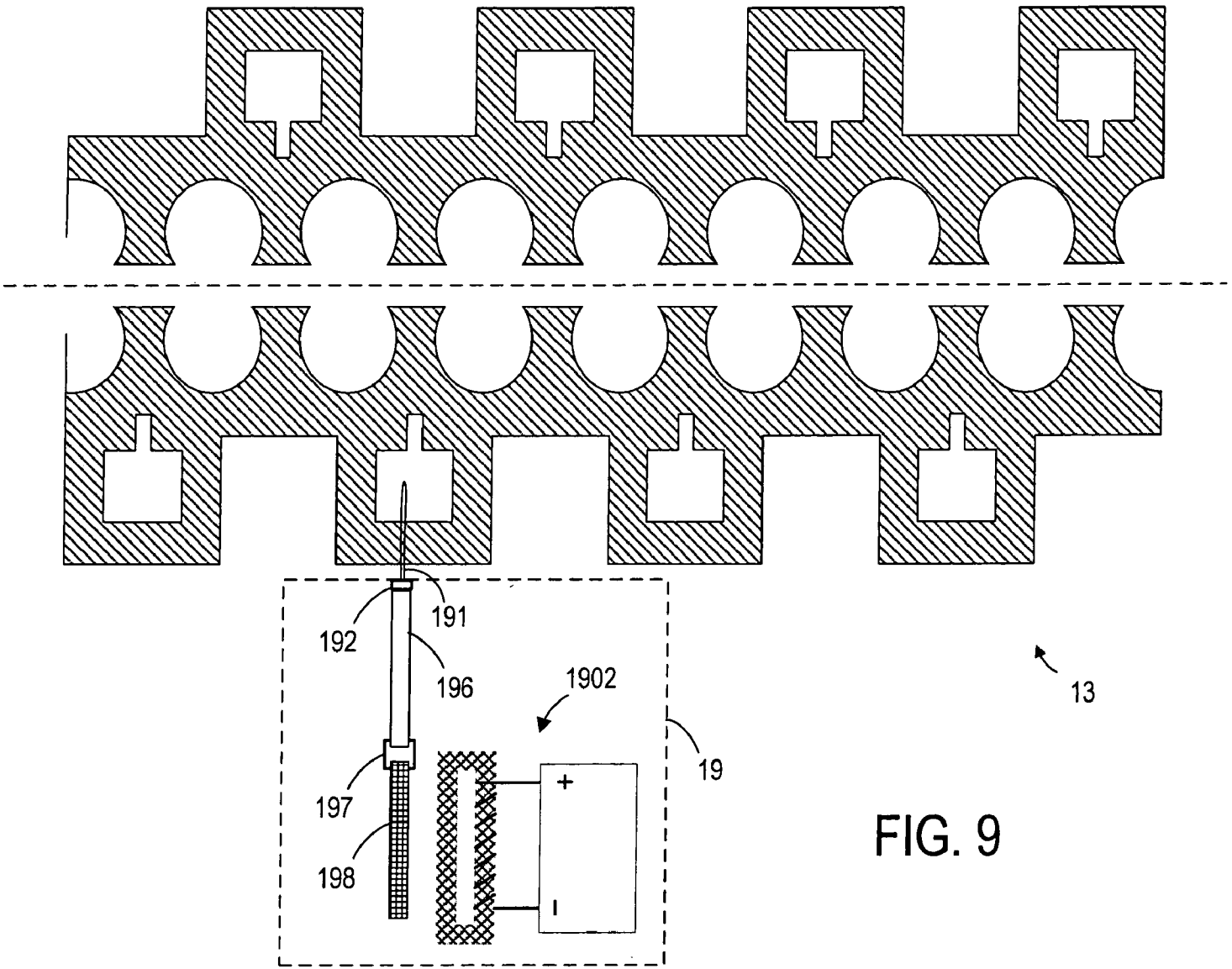
FIG. 9 is a cross-section of an accelerator waveguide according to some embodiments.

FIG. 9 is a cross-sectional view of waveguide 13 with device 19 according to some embodiments. Conductor loop 191, conductive coaxial cable sleeve 192, transmission line 196, switch 197, and transmission line 198 may be arranged as described with respect to FIG. 7. However, transmission line 198 includes a material that exhibits a reactance that depends on a field applied thereto.

Device 1902 is illustrated again in FIG. 8 as a field device for applying a field to the material within transmission line 198. Device 1902 may thereby change a reactance of transmission line 198 and therefore change a reactance coupled to side cavity 132*c* if transmission line 198 is coupled thereto by switch 197. In this regard, switch 197 may selectively couple or uncouple conductor loop 191 to or from transmission line 198. Such coupling/uncoupling may also change an amount of reactance coupled to side cavity 132*c*.

Therefore, field device 1902 may change a field applied to transmission line 198 and/or transmission line may be coupled/uncoupled to/from conductor loop 191 using the FIG. 9 embodiment. Any of these operations may change a resonant frequency of side cavity 132*c* and/or change a percentage of RF power delivered to primary cavities disposed downstream of side cavity 132*c* in step 42 of process 40. According to some embodiments, transmission line 198 of FIG. 9 is directly coupled to conductor loop 191 and both switch 197 and transmission line 196 are eliminated.

Those in the art will appreciate that various adaptations and modifications of the above-described embodiments can be configured without departing from the scope and spirit of the claimed invention. Therefore, it is to be understood that, within the scope of the appended claims, the claimed invention may be practiced other than as specifically described herein.

What is claimed is:

1. An apparatus comprising:

an accelerator waveguide to receive RF power, the accelerator waveguide comprising a side cavity;

an element disposed in a position within the side cavity; and a device coupled to the element, wherein the device and the element are operable to change a resonant frequency of the side cavity while the element remains stationary in the position within the side cavity.

2. An apparatus according to claim 1, wherein the device and the element are operable to change the resonant frequency to a first frequency in a first mode and to change the resonant frequency to a second frequency in a second mode, and wherein the accelerator waveguide is operable to output first particles at a first dose rate in the first mode and to output second particles at a second dose rate in the second mode.

3. An apparatus according to claim 2, wherein the first frequency is a tuned resonant frequency and wherein the first dose rate is less than the second dose rate.

4. An apparatus according to claim 3, wherein an energy of the first particles is substantially similar to an energy of the second particles.

5. An apparatus according to claim 2, further comprising:

an RF power source to transmit a first wave having a first power to the accelerator waveguide in the first mode, and to transmit a second wave having a second power to the accelerator waveguide in the second mode, wherein the first power is less than the second power, wherein the first dose rate is less than the second dose rate, and wherein an energy of the first particles is substantially similar to an energy of the second particles.

6. An apparatus according to claim 1, wherein the element comprises an electrical conductor, and wherein the device comprises an electrical circuit coupled to the electrical conductor.

7. An apparatus according to claim 6, wherein a characteristic of the electrical circuit is controllable to change an amount of reactance coupled to the side cavity.

8. An apparatus according to claim 6, the electrical circuit comprising:

a switch coupled to the electrical conductor;

a first transmission line coupled to the switch; and a second transmission line coupled to the switch, wherein the switch is operable to selectively couple the first transmission line or the second transmission line to the electrical conductor.

9. An apparatus according to claim 6, the electrical circuit comprising:

a first transmission line coupled to the electrical conductor;

a second transmission line; and a switch to selectively couple the first transmission line to the second transmission line.

10. An apparatus according to claim 6, the electrical circuit comprising:

a first transmission line coupled to the electrical conductor, the first transmission line comprising a material having a reactance based on an applied field, the device further comprising:

a field device to apply a field to the material.

11. An apparatus according to claim 10, wherein the material comprises a ferrite and the field device comprises an electromagnet.

12. An apparatus according to claim 1, wherein the element comprises a material having a reactance based on an applied field, and wherein the device comprises a field device to apply a field to the material.

13. An apparatus according to claim 12, wherein the material comprises a ferrite and the field device comprises an electromagnet.

14. An apparatus according to claim 12, wherein the material comprises a ferroelectric material and the field device comprises a high voltage source.

15. An apparatus comprising:

an accelerator waveguide to receive RF power, the accelerator waveguide comprising a primary cavity, a side cavity coupled to the primary cavity, and one or more downstream primary cavities that are disposed downstream from the primary cavity;

an element disposed in a position within the side cavity; and a device coupled to the element, wherein the device and the element are operable while the element remains stationary in the position within the side cavity to selectively change a percentage of received RF power delivered to the downstream primary cavities.

16. An apparatus according to claim 15, wherein the device and the element are operable to cause a first percentage of received RF power to be delivered to the downstream primary cavities in a first mode and to cause a second percentage of received RF power to be delivered to the downstream primary cavities in a second mode, and wherein the accelerator waveguide is operable to output first particles at a first dose rate in the first mode and to output second particles at a second dose rate in the second mode.

17. An apparatus according to claim 16, wherein the first percentage is greater than the second percentage and wherein the first dose rate is less than the second dose rate.

18. An apparatus according to claim 17, wherein an energy of the first particles is substantially similar to an energy of the second particles.

19. An apparatus according to claim 17, further comprising:

an RF power source to transmit a first wave having a first power to the accelerator waveguide in the first mode, and to transmit a second wave having a second power to the accelerator waveguide in the second mode, wherein the first power is less than the second power, wherein the first percentage is greater than the second percentage, wherein the first dose rate is less than the second dose rate, and wherein an energy of the first particles is substantially similar to an energy of the second particles.

20. An apparatus according to claim 15, wherein the element comprises an electrical conductor, and wherein the device comprises an electrical circuit coupled to the electrical conductor.

21. An apparatus according to claim 20, wherein a characteristic of the electrical circuit is controllable to change an amount of reactance coupled to the side cavity.

22. An apparatus according to claim 20, the electrical circuit comprising:

a transmission line coupled to the electrical conductor;

a second transmission line; and a switch to selectively couple the first transmission line to the second transmission line.

23. An apparatus according to claim 20, the electrical circuit comprising:

a switch coupled to the electrical conductor;

a first transmission line coupled to the switch; and a second transmission line coupled to the switch, wherein the switch is operable to selectively couple the first transmission line or the second transmission line to the electrical conductor.

24. Art apparatus according to Claim 20, the electrical circuit comprising:

a first transmission line coupled to the electrical conductor, the first transmission line comprising a material having a reactance based on an applied field, the device further comprising:

a field device to apply a field to the material.

25. An apparatus according to claim 24, wherein the material comprises a ferrite and the field device comprises an electromagnet.

26. An apparatus according to claim 24, wherein the material comprises a ferroelectric material and the field device comprises a high voltage source.

27. An apparatus according to claim 15, wherein the element comprises a material having a reactance based on an applied field, and wherein the device comprises a field device to apply a field to the material.

28. An apparatus according to claim 27, wherein the material comprises a ferrite and the field device comprises an electromagnet.

29. A method comprising:

operating an accelerator waveguide to output first particles at a first dose rate;

operating an element disposed in a position within a side cavity of the accelerator waveguide and a device coupled to the element to change a resonant frequency of the side cavity while the element remains stationary in the position within the side cavity; and operating the accelerator waveguide to output second particles at a second dose rate.

30. A method according to claim 29, wherein the first particles are output at a first energy and the second particles are output at substantially the first energy.

31. A method according to claim 30, wherein the resonant frequency is a tuned resonant frequency when operating the accelerator waveguide to output the first particles at the first dose rate, and wherein the first dose rate is less than the second dose rate.

32. A method according to claim 30, wherein operating the accelerator waveguide to output the first particles at the first dose rate comprises transmitting a first wave having a first power to the accelerator waveguide, wherein operating the accelerator waveguide to output the second particles at the second dose rate comprises transmitting a second wave having a second power to the accelerator waveguide, wherein the first power is less than the second power, and wherein the first dose rate is less than the second dose rate.

33. A method according to claim 29, wherein operating the element and the device comprises changing an amount of reactance coupled to the side cavity.

34. A method according to claim 33, wherein changing an amount of reactance coupled to the side cavity comprises:

operating the device to couple a transmission line to the element.

35. A method according to claim 33, wherein changing an amount of reactance coupled to the side cavity comprises:

operating a second device to apply a field to the device, wherein the device comprises a material having a reactance based on an applied field.

36. A method according to claim 35, wherein the material comprises a ferrite and the second device comprises an electromagnet.

37. A method according to claim 33, wherein changing an amount of reactance coupled to the side cavity comprises:

operating the device to apply a field to the side cavity, wherein the element comprises a material having a reactance based on an applied field.

38. A method according to claim 37, wherein the material comprises a ferrite and the device comprises an electromagnet.

* * * * *